US007281621B2

(12) United States Patent
Jahnke et al.

(10) Patent No.: US 7,281,621 B2
(45) Date of Patent: Oct. 16, 2007

(54) APPARATUS FOR THE TRANSFER OF ROD-SHAPED ARTICLES

(75) Inventors: Matthias Jahnke, Hamburg (DE); Konrad Popp, Augsburg (DE)

(73) Assignee: Hauni Maschinenbau AG, Hamburg (DE)

( * ) Notice: Subject to any disclaimer, the term of this patent is extended or adjusted under 35 U.S.C. 154(b) by 105 days.

(21) Appl. No.: 11/225,071

(22) Filed: Sep. 14, 2005

(65) Prior Publication Data

US 2006/0076215 A1 Apr. 13, 2006

(30) Foreign Application Priority Data

Sep. 24, 2004 (DE) ..... 10 2004 047 266

(51) Int. Cl.
*B65G 17/46* (2006.01)

(52) U.S. Cl. ..... 198/471.1; 131/282

(58) Field of Classification Search ..... 198/469.1, 198/471.1, 474.1, 475.1, 476.1, 428, 430; 131/280, 282

See application file for complete search history.

(56) References Cited

U.S. PATENT DOCUMENTS

| | | | | |
|---|---|---|---|---|
| 3,521,513 A | | 7/1970 | Gömann et al. | |
| 3,567,011 A | * | 3/1971 | Pinkham | 198/471.1 |
| 4,408,621 A | * | 10/1983 | Schumacher | 131/282 |
| 4,827,948 A | * | 5/1989 | Schumacher | 198/471.1 |
| 5,255,777 A | * | 10/1993 | Pawelko | 198/471.1 |
| 5,327,803 A | * | 7/1994 | deMey, III | 198/471.1 |
| 5,480,021 A | * | 1/1996 | Belvederi et al. | 198/471.1 |
| 7,131,524 B2 | * | 11/2006 | Wohltmann | 198/471.1 |

FOREIGN PATENT DOCUMENTS

| | | |
|---|---|---|
| DE | 244236 C | 6/1911 |
| DE | 649219 C | 8/1937 |
| DE | 1 087 317 B | 8/1960 |
| DE | 23 45 063 B | 3/1974 |
| DE | 25 05 516 B2 | 8/1975 |
| DE | 25 49 512 C2 | 5/1977 |
| DE | 75 34 019 U1 | 2/1979 |
| DE | 28 09 160 A1 | 9/1979 |
| DE | 28 46 279 C2 | 4/1980 |
| DE | 34 18 935 A1 | 11/1984 |
| DE | 40 35 326 C1 | 4/1992 |

* cited by examiner

*Primary Examiner*—James R. Bidwell
(74) *Attorney, Agent, or Firm*—Venable LLP; Robert Kinberg; Kyle D. Petaja

(57) ABSTRACT

A transfer apparatus is provided for the transfer of rod-shaped articles, in particular filter rods, from a conveying apparatus for transverse axial conveying of the articles to a conveying apparatus for longitudinal axial conveying of the articles or vice versa. The directions of transport of the conveying apparatuses running transversely to each other. The transfer apparatus includes a rotatably driveable conveyor with at least one receptacle. Each receptacle is adapted to take at least one article off the conveying apparatus for transverse axial conveying of the articles and discharging the or each received article to the conveying apparatus for longitudinal axial conveying or vice versa. Each receptacle traverses a variable running circle. Several receptacles are evenly distributed over the circumference of the conveyor, all the receptacles being radially displaceable synchronously during operation of the apparatus.

23 Claims, 7 Drawing Sheets

APPARATUS FOR THE TRANSFER OF ROD-SHAPED ARTICLES

CROSS-REFERENCE TO RELATED APPLICATION

This application claims the priority of German Patent Application No. 10 2004 047 266.1 filed Sep. 24, 2004, the subject matter of which is incorporated herein by reference. The disclosure of all U.S. and foreign patents and patent applications mentioned below are also incorporated herein by reference.

BACKGROUND OF THE INVENTION

The invention concerns an apparatus for the transfer of rod-shaped articles, in particular filter rods, from an apparatus for transverse axial conveying of the articles to an apparatus for longitudinal axial conveying of the articles or vice versa, the directions of transport of the apparatuses running transversely to each other, including a rotatably driveable conveying means with at least one receptacle, each receptacle being designed for taking at least one article off the apparatus for transverse axial conveying of the articles and discharging the or each received article to the apparatus for longitudinal axial conveying or vice versa.

Apparatuses of this kind are used in particular in the tobacco-processing industry. The rod-shaped articles can be e.g. filters, filter segments or segment groups as well as cigarettes or the like. In the treatment or manufacture of such articles, on account of machines and apparatuses arranged at angles it is necessary to convert the articles from transverse axial conveying to longitudinal axial conveying or vice versa. This purpose is served by the generic apparatus.

The apparatus mentioned must, however, be adapted to the respective length and/or the respective diameter of the articles to be transferred in order to obtain optimum productivity. This is explained below by the example of manufacturing filters. Each filter usually consists of one or more components, the so-called segments, which are surrounded with wrapping material. Depending on requirements and/or customer wishes, filters have a different length and/or different diameter. In the past, filters often consisted of a single component. Nowadays the filter is usually formed from several components. In this case different filter lengths arise, which as a rule are within a range from about 21 to 27 mm. Other lengths are, however, also standard. Furthermore there may also be variations in diameter. Filters or the filter material or the filter segments are prepared in a single or multiple working length or in segment groups of different length, and transported transversely axially in the direction of the generic apparatus. By means of the last-mentioned apparatus, the articles are transferred to the apparatus for longitudinal axial conveying, to the actual continuous rod-making machine. On the continuous rod-making machine, the individual filter segments or filter segments assembled in groups are surrounded with wrapping paper and cut into the final filters.

A filter length or the length of the filter segments or segment groups is also referred to as the format. During manufacture it frequently happens that a change of format is necessary. That is, production must be switched from a first length to a second length which differs from the first length, in order to achieve optimum utilisation of productivity of the apparatus as well as of the apparatuses arranged upstream or downstream. However, this switch necessitates a variation in the diameter of the conveying means or a variation in the running circle described by the rotating receptacles, in order to optimally adapt the device to each desired cut length of the filters. With modern-day apparatuses, this requires exchange of the whole conveying means. For each format there is a separate conveying means which must be exchanged when the machine stops. The change of format leads to considerable expenditure on assembly, which, like stopping of the machine, leads to elevated costs.

SUMMARY OF THE INVENTION

It is therefore the object of the present invention to provide an apparatus which ensures a change of format with reduced expenditure.

This object is achieved by an apparatus with the characteristics mentioned hereinbefore by the fact that the running circle L formed by the or each receptacle is variable. As a result, it is possible in a simple manner to adapt the conveying means to each format to be processed. Within a certain bandwidth, the device is suitable for the transfer of different formats. In other words, a single conveying means covers the common formats, so that a constant exchange of conveying means can be avoided. This saves expenditure on assembly and hence costs.

In an advantageous embodiment of the invention, the or each receptacle is radially displaceable to alter the running circle L. As a result, adaptation of the diameter of the running circle L can be achieved in a particularly simple manner with a constant number of receptacles. Radially displaceable in this context means, in addition to the actual radially directed movement, pivoting, tilting, rocking or other movements as well, which result in radial displacement of the running circle L.

In a preferred embodiment of the invention, several receptacles are evenly distributed over the circumference of the conveying means, all the receptacles being radially displaceable synchronously during operation of the apparatus. With this design, on-line adaptation of the conveying means to different formats is possible, preventing stopping of the machine. This leads to increased flexibility of the apparatus and a lowering of costs.

BRIEF DESCRIPTION OF THE DRAWINGS

Further preferred and advantageous characteristics and embodiments are apparent from the subsidiary claims and the description. Particularly preferred embodiments of the invention and the principle of the method are described in more detail below with the aid of the attached drawings. The drawings show:

DETAILED DESCRIPTION OF THE INVENTION

The shown apparatuses serve for the transfer of rod-shaped articles from an apparatus for transverse axial conveying of the articles to an apparatus for longitudinal axial conveying of the articles. The apparatuses may, however, be designed and used in the same way for transfer from an apparatus for longitudinal axial conveying to an apparatus for transverse axial conveying.

Figure 1:
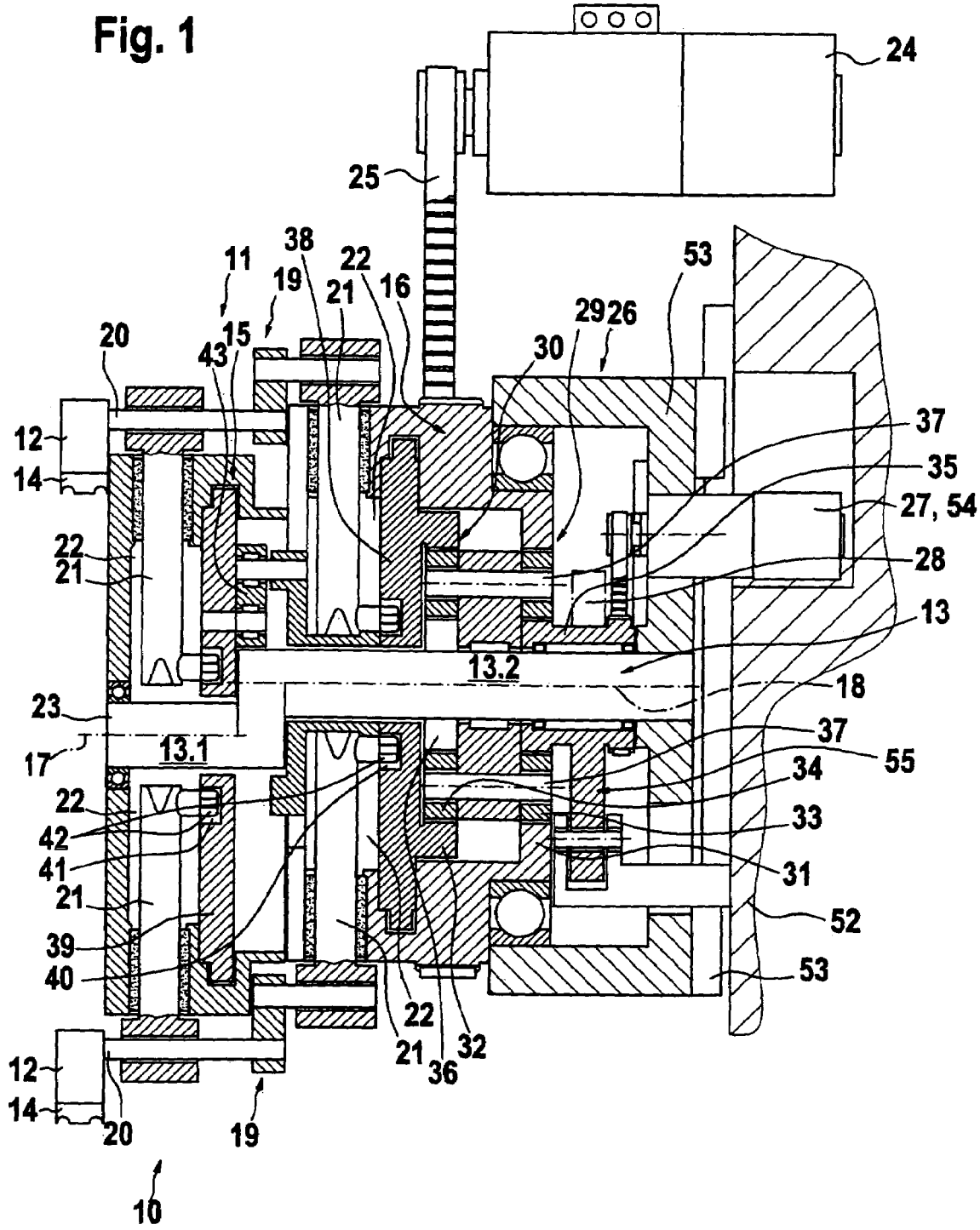
FIG. 1 a side view of a first embodiment of the apparatus for the transfer of rod-shaped articles in section, FIG. 2 a front view of the apparatus according to FIG. 1, FIG. 3 a variant of the first embodiment according to FIG. 1 in section, FIG. 4 a side view of a further embodiment of the apparatus for the transfer of rod-shaped articles in section, FIG. 5 a front view of the embodiment according to FIG. 4, FIG. 6 a side view of a further embodiment of the apparatus for the transfer of rod-shaped articles in section, and FIG. 7 a front view of the embodiment according to FIG. 6.
Figure 2:
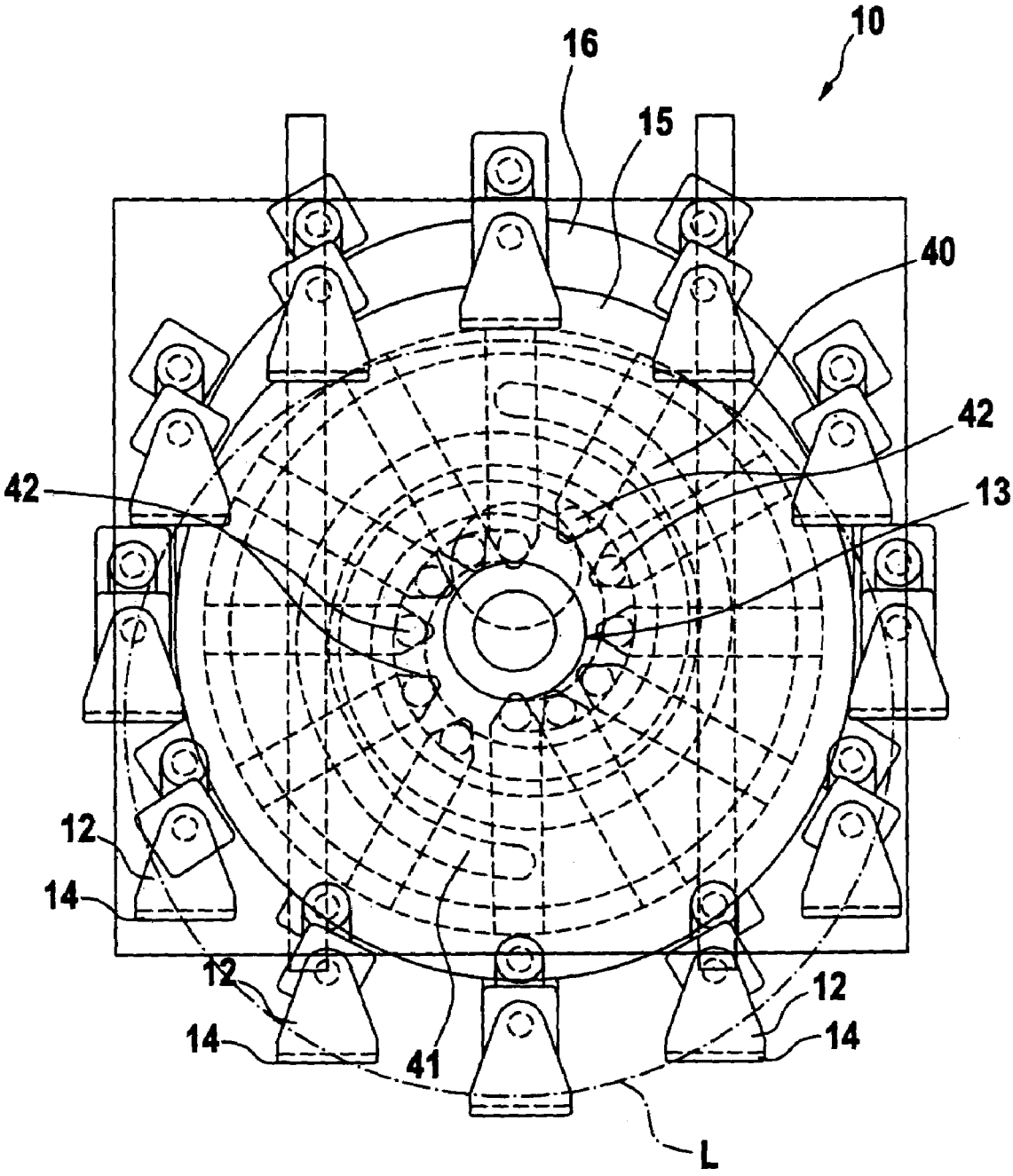

FIGS. 1 and 2 show a first embodiment of an apparatus 10 for the transfer of rod-shaped articles. The apparatus 10 is usually arranged between an apparatus (not shown) for transverse axial conveying of the articles, for example, a device for assembling groups of filter segments for the manufacture of multi-segment filters, and an apparatus (also not shown) for longitudinal axial conveying of the articles, for example, a rod-forming apparatus. The apparatus 10 essentially includes a conveying means 11 which has at least one, but preferably more receptacles 12. The receptacles 12 serve for taking at least one article off the apparatus for transverse axial conveying and discharging the or each received article to the apparatus for longitudinal axial conveying. For this, the conveying means 11 is rotatable about a shaft 13. Several, preferably twelve receptacles 12 are evenly distributed over the circumference of the conveying means 11, all the receptacles 12 being radially displaceable synchronously during operation of the apparatus 10. Each receptacle 12 is arranged pivotably on the conveying means 11, so that format holders 14 which are associated with each receptacle 12 run parallel to the articles, preferably in each position, but in particular at the moment of receiving the articles and discharging the articles. This is usually the horizontal position. The format holders 14 are adapted to each format to be transferred, in particular as far as the length and diameter of the articles are concerned. The format holder 14 can be designed for receiving a single article, but also for receiving several articles arranged parallel and adjacent to each other. To alter the diameter of the conveying means 11 or the running circle L formed or described by the receptacles 12 rotating with the conveying means 11, the receptacles 12 are variable. Adjustment to different diameters can be made manually or automatically. In each embodiment, the or each receptacle 12 is radially displaceable to alter the running circle L. Radial displacement can be achieved by linear and/or circular or arcuate and/or pivoting, tilting or otherwise known and ordinary movement arrangements.

The conveying means 11 has two discs 15 and 16 which are centrally positioned on the common shaft 13. The shaft 13 which is preferably constructed in one piece is offset and parallel, i.e. it has two sections 13.1 and 13.2 which are offset from each other. The sections 13.1 and 13.2 or the axes of rotation 17 and 18 of the sections 13.1 and 13.2 run parallel to each other. The outer disc 15 which is arranged at the free end 23 of the shaft 13 or, to be more precise, of the section 13.1, and so in the described embodiment faces towards the apparatus for longitudinal axial conveying, is arranged on the section 13.1 and rotates about the axis of rotation 17. The inner disc 16 is arranged on the section 13.2 and rotates about the axis of rotation 18. Correspondingly, the discs 15, 16 are arranged parallel to and axially offset from each other. The two discs 15, 16 are coupled and so functionally connected to each other by joint elements 19, so as to rotate about the axes of rotation 17 at the same speed. The receptacles 12 are associated with the front disc 15. To be more precise, the receptacles are arranged at free ends 20 of the joint elements 19 which protrude from the disc 15.

The discs 15, 16 in the shown embodiment have the same diameter. The diameters can, however, be different. Each disc 15, 16 has adjusting elements 21. The adjusting elements 21 are arranged in the region of the circumference of the respective disc 15 or 16. The number of adjusting elements 21 per disc 15, 16 preferably corresponds to the number of receptacles 12. The adjusting elements 21 are segmented, i.e. each adjusting element 21 is separate from the adjacent adjusting element 21. Each receptacle 12 is assigned to pair of adjusting elements. The pair of adjusting elements is composed of an adjusting element 21 of disc 15 and a corresponding adjusting element 21 of disc 16. The adjusting elements 21 of a pair are arranged one behind the other in a front view. The connection between the discs 15, 16 or between the adjusting elements 21 of each pair is made by the joint elements 19 which, like the shaft 13, are arranged parallel and offset or angled. The joint elements 19 are mounted in the adjusting elements 21, so that, in spite of rotation of the discs 15, 16, the receptacles 12 arranged on the joint elements 19 are always in the same position in relation to the orientation to the articles. The adjusting elements 21 are arranged in recesses 22 of the discs 15, 16.

The conveying means 11 or, to be more precise, the discs 15, 16 are rotatable by means of a drive 24. The drive 24 is operatively connected to one of the discs 15, 16, preferably the inner disc 16, by a toothed belt 25 or other common transmission elements. By the joint elements 19, rotation of the disc 16 can be transmitted to the disc 15. The two discs 15, 16 rotate at the same speed. To alter the diameter of the conveying means 11 or of the running circle L described by the receptacles 12 arranged on the conveying means 11, an additional movement can be superimposed on the rotational movement of the discs 15, 16.

All the shown embodiments according to FIGS. 3 to 7 are basically constructed on the same principle as the embodiment of FIGS. 1 and 2 described above, so that a repeated description is dispensed with. The same reference numerals are used for identical parts. The different embodiments differ, however, in the construction of the mechanism for adjustment of the running circle L formed by the receptacles 12. In other words, various possible ways in which an additional adjusting movement can be superimposed on the actual rotational movement of the conveying means, namely the discs 15, 16, are described below.

According to the embodiment of FIGS. 1 and 2, associated with the conveying means 11 for superimposing an additional movement is a gear mechanism, in particular an addition gear mechanism 26. The addition gear mechanism 26 is functionally connected to an adjusting drive 27 and can be driven by the latter. The functional connection between the adjusting drive 27 and the addition gear mechanism 26 is made by a toothed belt 28 or other common transmission elements. The addition gear mechanism 26 essentially includes two planetary gear mechanisms 29, 30 which are connected in parallel with each other. The two planetary gear mechanisms 29, 30 have a hollow wheel 31, 32, a set of planet wheels 33, 34 and a sun wheel 35, 36. Each set of planet wheels 33, 34 includes several planet wheels, two planet wheels being provided in the shown embodiment. Here, one planet wheel each of set 33 is connected to one planet wheel of set 34 via a shaft 37. The sun wheel 35 driven by the adjusting drive 27 is centrally positioned or mounted on the shaft 13. The sun wheel 36 is non-rotatably arranged on the shaft 13. The hollow wheel 31 associated with the set of planet wheels 33 is an integral part of the disc 16. The hollow wheel 32 is simultaneously designed as an adjusting wheel 38.

Associated with the conveying means 11 is at least one adjusting wheel. Preferably, however, each disc 15, 16 has an adjusting wheel. The adjusting wheel 39 is associated with the disc 15. The adjusting wheel 38 is associated with the disc 16. The two adjusting wheels 38, 39 each have a face cam 40, 41. The face cams 40, 41 run, starting from the shaft 13, spirally outwards to the circumference of the discs 15, 16. To make a functional connection between the adjusting wheels 38, 39 and the discs 15, 16 or the adjusting elements 21 associated with the discs 15, 16, the adjusting elements 21 each have a journal 42 or the like. The journals 42 of all the adjusting elements 21 are guided in the face cams 40, 41, which can also be referred to as control cams or adjusting cams. The journals 42 of the adjusting elements 21 which are associated with the disc 16 are associated with the face cam 40 of the adjusting wheel 38. The journals 42 of the adjusting elements 21 which are associated with the disc 15 are associated with the face cam 41 of the adjusting wheel 39. The adjusting wheels 38, 39 are coupled together by means of suitable coupling elements, preferably Schmidt couplings 43, to perform a synchronous movement. Other known types of coupling, e.g. Oldham couplings or cardan shafts or other ordinary coupling elements, can be used too.

Figure 3:
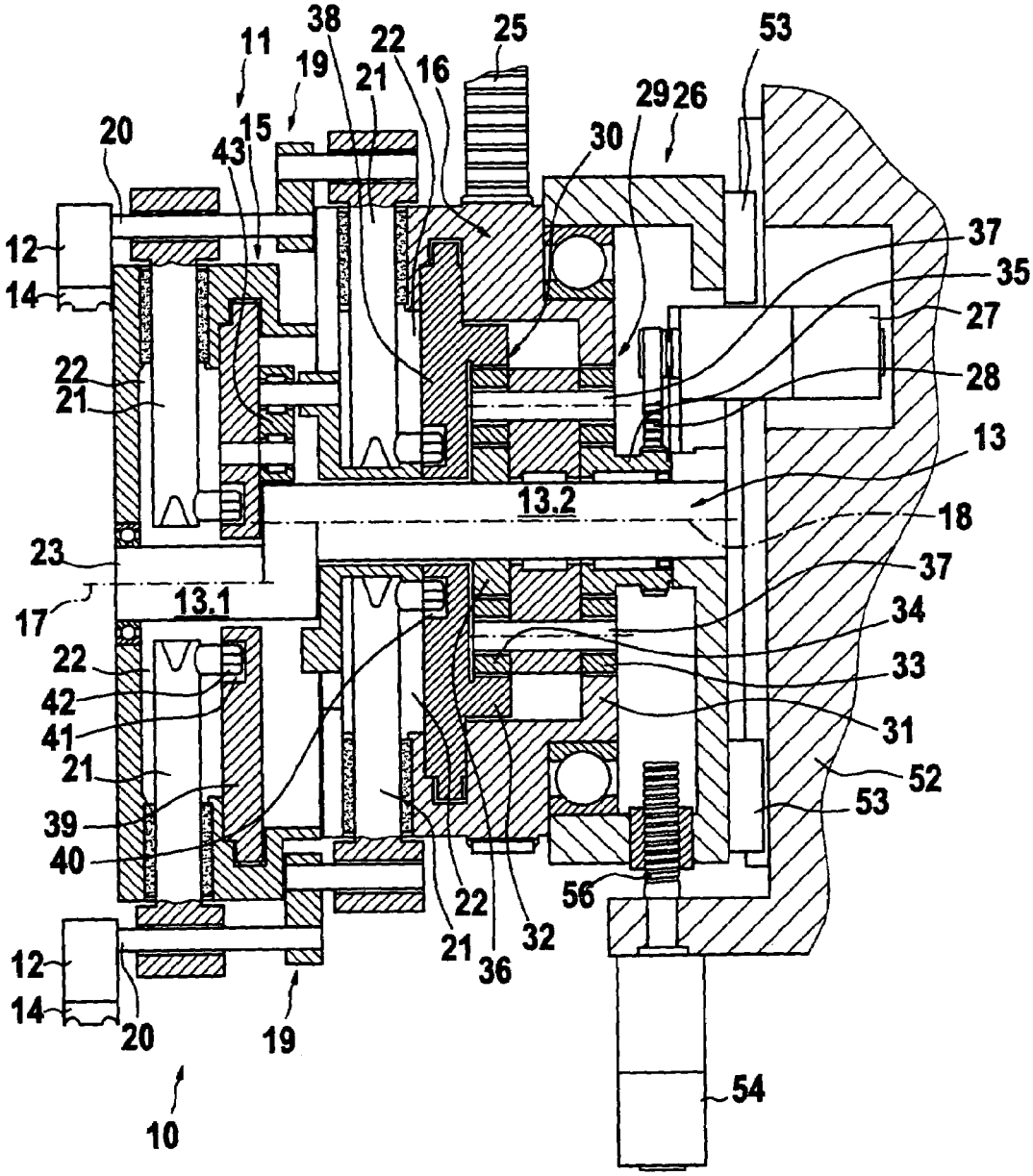

The manner of operation of the embodiment according to FIGS. 1 and 2 and also the embodiment of FIG. 3, which differs from the embodiment of FIGS. 1 and 2 only in the height adjustment, which is described below, is as follows. The conveying means 11 or the discs 15, 16 rotate at the same speed and take off the article or articles from a first apparatus at a take-off point and discharge them at a discharge point to a second apparatus. As soon as another format is to be transferred, a further movement is superimposed on the rotation of the discs 15, 16 in order to adapt the conveying means 11 to the new format. The adjusting drive 27 is actuated for this. The rotation of the sun wheel 35 is transmitted via the sets of planet wheels 33, 34 to the annulus 32 or adjusting wheel 38 and by the coupling 43 to the adjusting wheel 39. The rotation of the adjusting wheels 38, 39 then causes radial displacement of the adjusting elements 21, because due to the rotating adjusting wheels 38, 39 and the face cams 40, 41 altering as a result, the positions of the journals 42 also change in relation to the shaft 13. Depending on the direction of rotation of the adjusting drive 27, the receptacles 12 arranged on the adjusting elements 21 move radially outwards or inwards, so that the running circle L is thus made larger or smaller.

Figure 4:
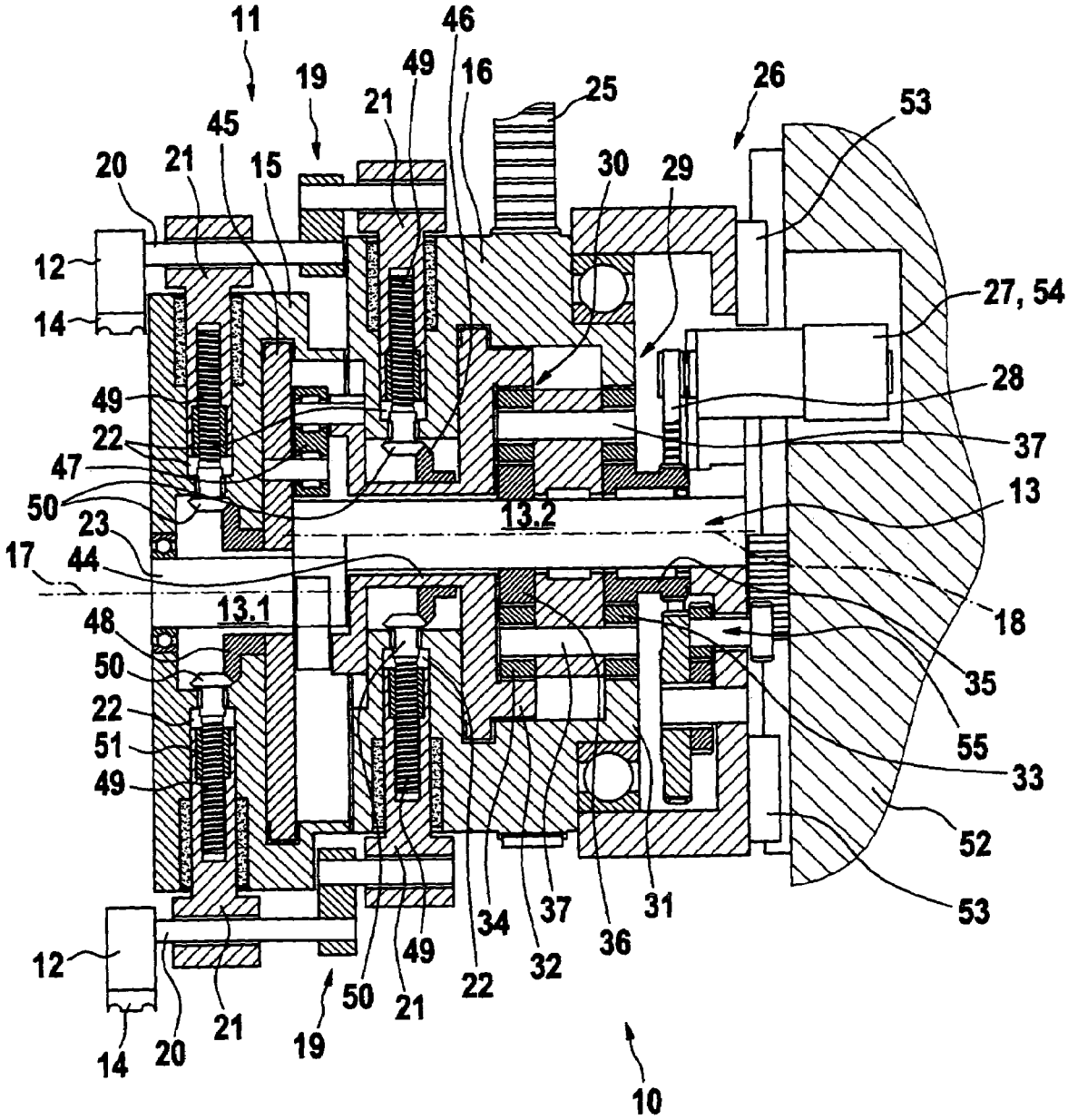
Figure 5:
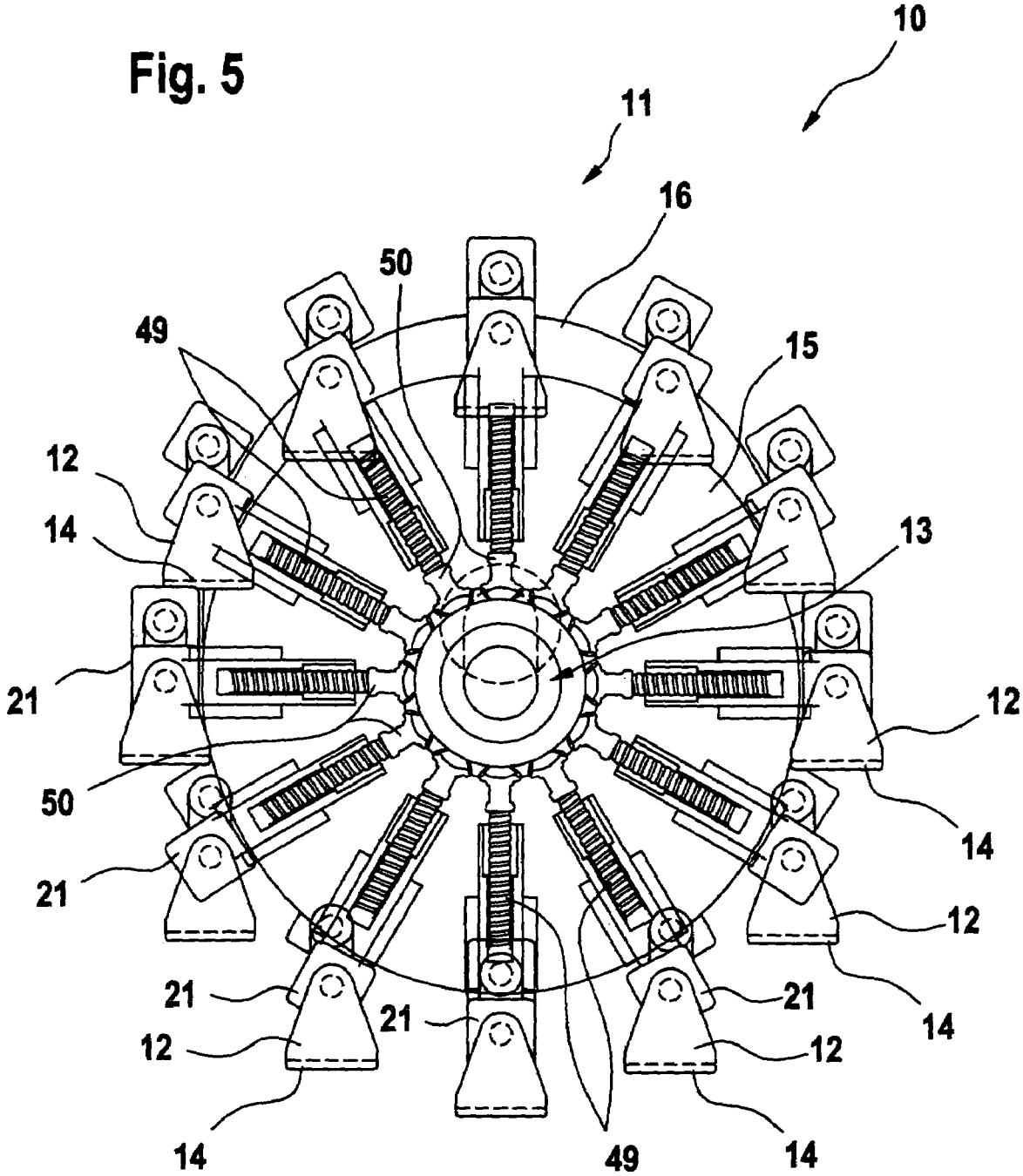

In the embodiment according to FIGS. 4 and 5, at least one adjusting wheel is also associated with the conveying means 11. Preferably, however, one adjusting wheel 44, 45 is associated with each disc 15, 16. The adjusting wheel 44 is associated with the disc 16. The adjusting wheel 45 is associated with the disc 15. The adjusting wheel 44 is an integral part of the annulus 32. Further, a bevel gear wheel 46 is associated with the adjusting wheel 44. The adjusting wheel 45 is connected to the adjusting wheel 44 via suitable couplings 47 which correspond to the couplings 43. Also a bevel gear wheel 48 is associated with the adjusting wheel 45.

In this embodiment, each adjusting element 21 has a spindle 49. Each of the spindles 49 is radially oriented to the shaft 13 and provided with a bevel gear 50 for making the functional connection to one of the two adjusting wheels 44, 45. For this purpose the bevel gears 50 are engaged with the bevel gear wheels 46 or 48. The spindles 49 run in threaded guides 51 which each adjusting element 21 comprises.

The manner of operation of the embodiment according to FIGS. 4 and 5 is as follows. To superimpose the adjusting movement, the adjusting drive 27 is actuated. Rotation of the sun wheel 35 is transmitted via the sets of planet wheels 33, 34 to the annulus 32 or the adjusting wheel 44 and by the coupling 47 to the adjusting wheel 45. Rotation of the adjusting wheels 44, 45 then causes radial displacement of the adjusting elements 21. By rotation of the spindles 49 which are driven via the pairs of bevel gear wheels 46, 50 or 48, 50, the adjusting elements 21 with their threaded guides 51 run as it were up and down or radially outwards or inwards on the spindles 49 as a function of the direction of rotation of the adjusting wheels 44, 45. Correspondingly, the receptacles 12 move in a radial direction to vary the diameter of the running circle L.

The whole unit consisting of conveying means 11, addition gear mechanism 26 and coupling(s) 43 or 47 is arranged on a frame 52 and guided on or in linear guides 53. By an adjusting drive 54, the whole unit is adjustable in height. The height adjustment serves to equalise the change of diameter of the conveying means 11 or to equalise the radial displacement of the receptacles 12. In the embodiment according to FIG. 1, the adjusting drive 27 and the adjusting drive 54 are designed as a single adjusting drive. For height adjustment, the common adjusting drive is also functionally connected to a gear wheel assembly 55. The same applies to the embodiment according to FIG. 4. In the embodiment according to FIG. 3, the adjusting drives 27 and 54 are separate from each other. In it, the adjusting drive 54 drives a spindle 56 which leads to adjustment of the height position of the unit along the linear guides 53.

Figure 6:
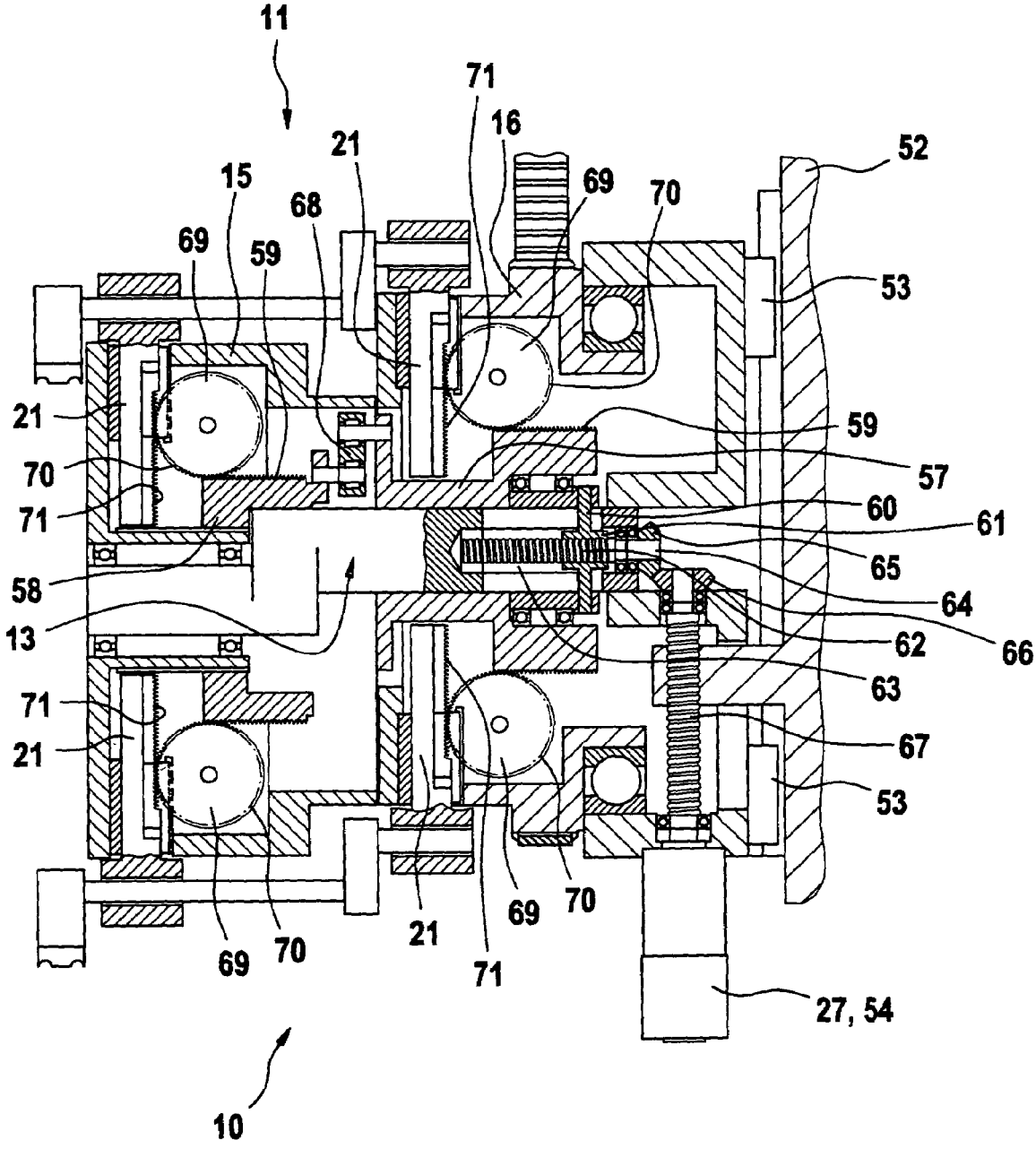
Figure 7:
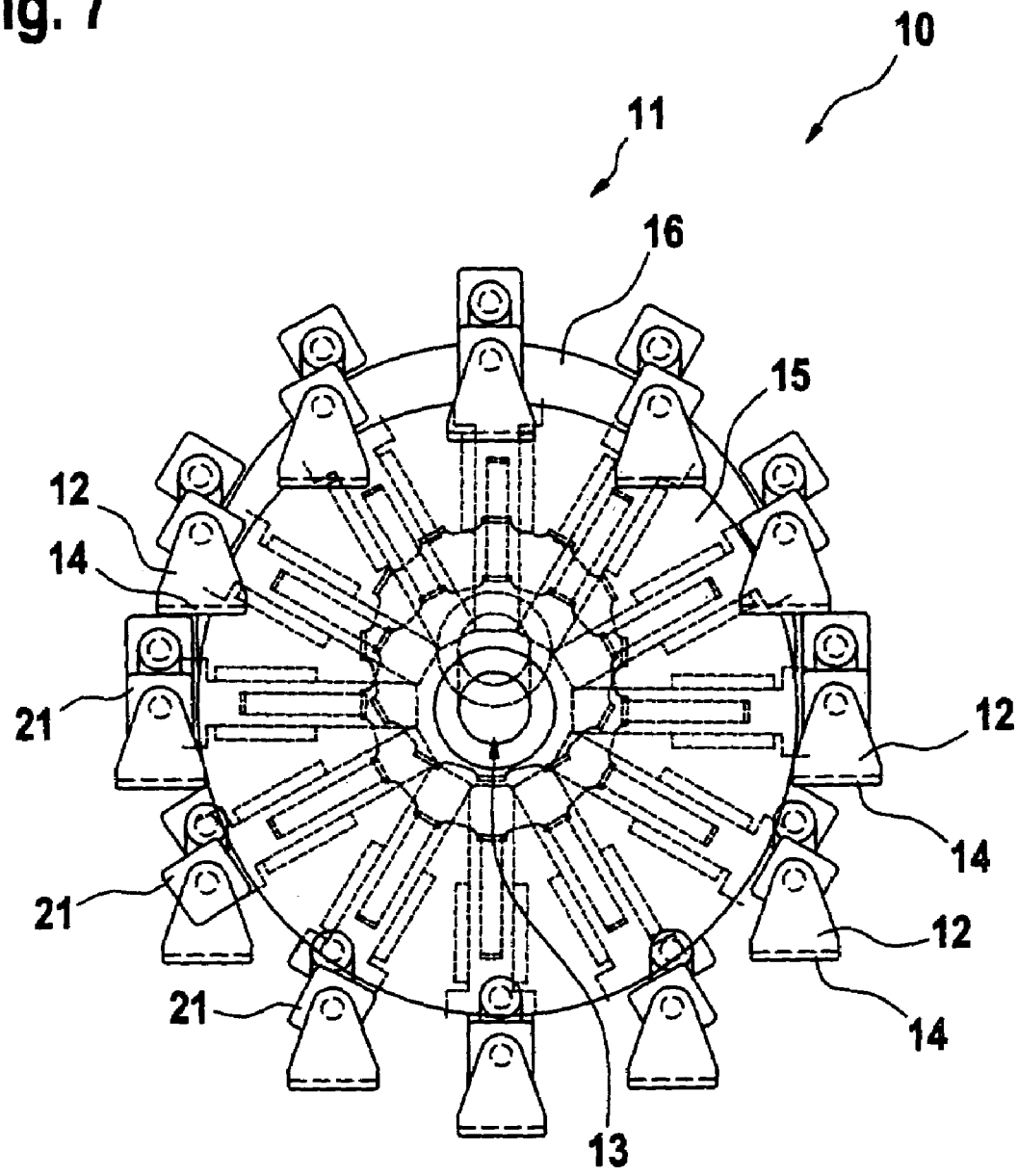

Variation of the running circle L is achieved in the embodiment according to FIGS. 6 and 7 by a pinion assembly. At least one adjusting wheel is associated with the conveying means 11. Preferably, one adjusting wheel 57, 58 is associated with each disc 15, 16, the adjusting wheel 57 being associated with the disc 16 and the adjusting wheel 58 with the disc 15. The adjusting wheels 57, 58 comprise grooving 59 which has no pitch. The adjusting wheels 57, 58 are movable in the manner of operation of a gear rack accordingly and in the axial direction of the shaft 13. In other words, the adjusting wheels 57, 58 replace twelve gear racks in the case of a number of twelve receptacles 12. The adjusting wheel 57 is for this purpose connected to a carrier element 60 which is arranged on a sleeve 61. The sleeve 61 is arranged on a spindle 62 which is arranged rotatably, in an axial direction but stationarily in the region of the shaft 13, preferably in a recess 63 of the shaft 13 in its longitudinal extent. At the free end 64 of the spindle 62 is arranged a bevel gear wheel 65 which is engaged with a bevel gear wheel 66 of a further spindle 67. The spindle 67 is rotatable by means of the adjusting drive 27, which at the same time is also the adjusting drive 54 for height adjustment.

The adjusting wheel 58 is functionally connected to the adjusting wheel 57 via a coupling 68, which corresponds to the coupling 43 of the embodiment described above, so that the axial movement of the adjusting wheel 58 can be transmitted to the adjusting wheel 57. Associated with each adjusting element 21 is a pinion 69 which comprises grooving 70 which corresponds to the grooving 59 of the adjusting wheels 57, 58. Also, the adjusting elements 21 have grooving 71. The pinions 69 thus serve to make a functional connection between the adjusting wheels 57, 58 on the one hand and the adjusting elements 21 on the other hand.

The apparatus 10 according to FIGS. 6 and 7 functions basically as follows. To superimpose the adjusting movement, the adjusting drive 27 is actuated. By rotation of the bevel gear wheel 66 and hence of the bevel gear wheel 65, the sleeve 61 is displaced forwards or rearwards in an axial direction as a function of the direction of rotation. By means of the carrier element 60, this axial movement is transmitted to the adjusting wheel 57. The coupling 68 transmits the axial movement to the adjusting wheel 58, so that the axial movements of the adjusting wheels 57, 58 run synchronously. The axial movement of the adjusting wheels 57, 58 is converted to a rotating movement of the pinions 69, the rotating movement of the pinions 69 in turn being converted to an axial movement of the adjusting elements 21. The axial movement of the adjusting elements 21 leads to alteration of the position of the receptacles 12 which describe the running circle L. In coordination with variation of the running circle L, the height of the unit consisting of conveying means 11, adjusting wheels 57, 58 and coupling(s) 68 is adapted by the spindle 67.

Furthermore, a control system can be associated with the apparatus 10 in all the embodiments, in such a way that displacement of the apparatus 10, that is, in particular radial displacement of the receptacles 12 and adaptation of the height of the whole unit can be carried out automatically in a coordinated fashion by "pushing a button". For this purpose, the drive 24 and the adjusting drives 27 and 54 are connected to the control system.

The invention has been described in detail with respect to exemplary embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A transfer apparatus for the transfer of rod-shaped articles, in particular filter rods, from a conveying apparatus for transverse axial conveying of the articles to a conveying apparatus for longitudinal axial conveying of the articles or vice versa, the directions of transport of the conveying apparatuses running transversely to each other, the transfer apparatus including: a rotatably driveable conveyor with at least one receptacle, each receptacle being adapted to take at least one article off the conveying apparatus for transverse axial conveying of the articles and discharging the or each received article to the conveying apparatus for longitudinal axial conveying or vice versa, wherein each receptacle traverses a variable running circle and wherein several receptacles are evenly distributed over the circumference of the conveyor, all the receptacles being radially displaceable synchronously during operation of the apparatus.

2. The transfer apparatus according to claim 1, characterized in that the or each receptacle is radially displaceable to alter the running circle.

3. The transfer apparatus according to claim 1, characterized in that the conveyor includes two discs which are arranged on a parallel offset shaft.

4. The transfer apparatus according to claim 3, characterized in that the receptacles are associated with the front disc arranged at the free end of the shaft.

5. The transfer apparatus according to claim 3, characterized in that the discs are connected to each other by joint elements, in such a way that the discs are rotatable synchronously.

6. The transfer apparatus according to claim 3, characterized in that the discs have the same diameter.

7. The transfer apparatus according to claim 3, characterized in that each disc has adjusting elements, the adjusting elements being arranged in the region of the circumference of the respective disc.

8. The transfer apparatus according to claim 7, characterized in that the number of adjusting elements of each disc corresponds to the number of receptacles.

9. The transfer apparatus according to claim 7, characterized in that associated with each adjusting element of the first disc is an adjusting element of the second disc for forming a pair of adjusting elements.

10. The transfer apparatus according to claim 9, characterized in that each pair of adjusting elements is functionally connected to each other by means of the joint elements.

11. The transfer apparatus according to claim 5, characterized in that the receptacles are arranged at free ends of the joint elements.

12. The transfer apparatus according to claim 3, characterized in that a drive is associated with the conveyor, the drive being directly functionally connected to one of the discs, preferably the rear disc.

13. The transfer apparatus according to claim 1, characterized in that associated with the conveyor is a gear mechanism, in particular an addition gear mechanism.

14. The transfer apparatus according to claim 13, characterized in that associated with the addition gear mechanism is an adjusting drive for superimposing an adjusting movement of the receptacles in addition to rotation thereof.

15. The transfer apparatus according to claim 1, characterized in that associated with the conveyor is at least one adjusting wheel with a face cam.

16. The transfer apparatus according to claim 15, characterized in that each adjusting element has a journal which, to make a functional connection to one of the adjusting wheels, is positioned in the corresponding face cam.

17. The transfer apparatus according to claim 1, characterized in that associated with the conveyor conveying means is at least one adjusting wheel with a bevel gear wheel.

18. The transfer apparatus according to claim 17, characterized in that associated with each adjusting element is a spindle which is oriented radially to the shaft and, to make a functional connection to one of the two adjusting wheels, is provided with a bevel gear wheel.

19. The transfer apparatus according to claim 1, characterized in that associated with the conveyor is at least one adjusting wheel with grooving having no pitch.

20. The transfer apparatus according to claim 19, characterized in that associated with each adjusting element is a pinion, wherein to make a functional connection the pinion is provided with grooving corresponding to the grooving of the adjusting wheels and engaged with corresponding grooving which is associated with each adjusting element.

21. The transfer apparatus according to claim 15, characterized in that the adjusting wheels are functionally connected to each other by a coupling.

22. The transfer apparatus according to claim 21, characterized in that the whole unit consisting of conveyor, addition gear mechanism or adjusting wheels and coupling(s) is adjustable in height.

23. The transfer apparatus according to claim 22, characterized in that an adjusting drive is associated with the unit.

* * * * *